US005315792A

United States Patent [19]

Schweizer et al.

[11] Patent Number: 5,315,792

[45] Date of Patent: May 31, 1994

[54] METHOD FOR PRODUCING SEALING FACES ON VALVES

[75] Inventors: Siegfried Schweizer, Bamberg; Werner Sefz, Oberaurach-Trossenfurt, both of Fed. Rep. of Germany

[73] Assignee: Robert Bosch GmbH, Stuttgart, Fed. Rep. of Germany

[21] Appl. No.: 952,199

[22] Filed: Sep. 28, 1992

Related U.S. Application Data

[63] Continuation of Ser. No. 394,035, Aug. 15, 1989, abandoned.

[30] Foreign Application Priority Data

Aug. 26, 1988 [DE] Fed. Rep. of Germany ..... 3828987
Jul. 28, 1989 [DE] Fed. Rep. of Germany ..... 3925043

[51] Int. Cl.[5] ..... B24B 15/04

[52] U.S. Cl. ..... 51/317; 51/27; 51/59 SS

[58] Field of Search ..... 51/281 P, 317, 292, 51/26, 27, 28, 29, 59 SS

[56] References Cited

U.S. PATENT DOCUMENTS

| | | | |
|---|---|---|---|
| 950,565 | 3/1910 | Cooke | 51/28 |
| 2,268,723 | 1/1942 | Scherer | 51/28 |
| 2,621,447 | 12/1952 | Beer | 51/28 |
| 4,043,084 | 8/1977 | Kuris | 51/59 SS |
| 4,903,439 | 2/1990 | Hoffman | 51/289 S |

FOREIGN PATENT DOCUMENTS

| | | | |
|---|---|---|---|
| 0378975 | 8/1923 | Fed. Rep. of Germany | 51/26 |
| 0039913 | 4/1957 | Poland | 51/73 |
| 0916267 | 3/1982 | U.S.S.R. | 51/59 SS |
| 1263503 | 10/1986 | U.S.S.R. | 51/34 C |
| 1293000 | 2/1987 | U.S.S.R. | 51/424 |
| 1509230 | 9/1989 | U.S.S.R. | 51/317 |

*Primary Examiner*—Robert A. Rose
*Attorney, Agent, or Firm*—Edwin E. Greigg; Ronald E. Greigg

[57] ABSTRACT

A method for treating valves having a sealing seat embodied on a movable valve element and a valve seat face embodied on a valve seat body in such a way as to improve the surface quality of the sealing faces. The movable valve element is set into a rotational motion, with pressure applied thereto toward the valve seat body held in a fixed position. During the rotational motion of the valve element a vibrational motion of ultrasonic range high frequency, acting parallel to the axis of rotation, is superimposed upon the rotary motion. Simultaneously a fine-grained lapping medium is applied to the valve seat face. The method is suitable for all valves having movable valve elements, the sealing seats of which cooperate with valve seat faces.

7 Claims, 1 Drawing Sheet

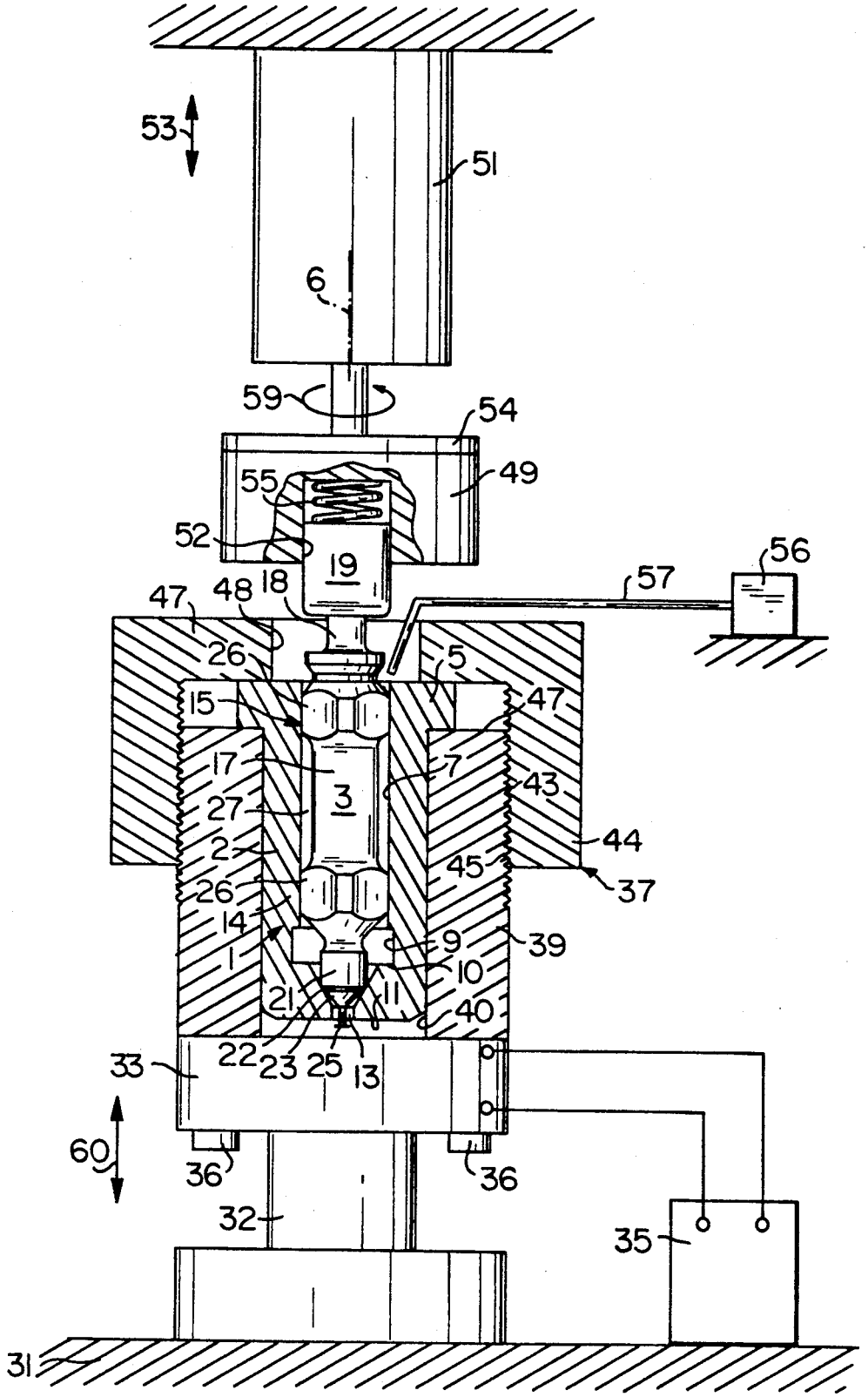
53
51
6
59
54
49
55
52
19
56
57
47
48
18
26
5
15
47
17
7
43
3
27
44
2
45
37
26
14
39
1
9
10
21
11
40
22
23
25
13
33
60
36
36
32
35
31

METHOD FOR PRODUCING SEALING FACES ON VALVES

This is a continuation of Ser. No. 07/394,035 filed on Aug. 15, 1989 now abandoned.

PRIOR ART

The invention is directed to a method and an apparatus for producing sealing faces on valves. To improve the tightness of fuel injection valves, valve seat bodies have been fastened in a holder unit, and that by pressure, the movable valve element made to contact the valve seat face and be set into rotation relative thereto, using a lapping medium. However, given the number of valve units (movable valve element and valve seat body) that have been arranged in this way, the resultant surface quality on the valve seat face and on the sealing seat of the movable valve element is still inadequate for sufficiently lasting tightness. For safety reasons and because of the need for quick operational readiness, fuel leakage and evaporation at the fuel injection valve should if possible be prevented for hours after the engine is shut off, when the fuel injection valve is closed and the fuel injection system is inoperative.

It is also already known to improve the surface quality of parts by machining them using a lapping medium; this can be done particularly by ultrasonic machining, which uses high-frequency vibrations (see Dubbels Taschenbuch für den Maschinenbau [Dubbel's Mechanical Engineering Handbook], Springer-Verlag, Berlin/-Heidelberg/New York, 1966, 12th Ed., Vol. 2, p. 659).

A method is also known for lapping in faucets (German Patent 639 666), in which one of the parts is clamped in place such that it can rotate about a longitudinal axis and can tilt and be displaced transversely to the longitudinal axis, but is fixed in the direction of the longitudinal axis, while the other part executes a compulsory rotational and reciprocating motion, respectively about and in the direction of the longitudinal axis, and grinding medium is applied in between the parts. The part executing the compulsory rotational and reciprocating motion executes a long-stroke, low-frequency frictional motion along a steep helical line of the entire jacket face of the other part, to which this reciprocating motion is not transmitted. As a result, undulating deviations of the generatrix of the conical surface are maximally avoided, although the known coarse grinding tracks of such a method remain in the axial and rotational direction, which need not meet stringent requirements for tightness.

ADVANTAGES OF THE INVENTION

The method according to the invention, have an advantage over the prior art by which a high surface quality of the sealing seat can be attained on both the movable valve element and the valve seat face on the valve seat body, which assures sufficiently lasting tightness of the valve while in use; the proportion of inadequately tight valve units (movable valve element and valve seat body) that must be re-machined or rejected has been determined to be less than 1%.

The invention is based on a finding that a simultaneous excitation of the valve seat body and movable valve part by a high-frequency vibration, with the interposition of a slurried fine-grained lapping medium, leads to a superfine removal of material at the sealing seat of the valve element and at the valve seat face, resulting in a quasi-amorphous surface structure, so that the conventionally known lapping or grinding structures are not present even when enlarged 1000 times. Although the movable valve part and the valve seat body vibrate at the same frequency, they do so at different amplitudes, producing a pump effect in the sealing seat gap that causes an axial relative movement of the lapping medium, so that the above-described effect of superfine material removal occurs at the defined faces without generating the familiar aligned surface structures.

The above-described effect of superfine removal in the sealing seat gap between the movable valve element and the valve seat body occurs even if these two parts rest on one another merely by their own weight. Thus, an additional force on the movable valve element in the direction of the valve seat face is initially unnecessary to attain an object of the invention, although, it can lead to an improvement in the results obtained. This additional force should naturally likewise be an element of the added-mass system that is capable of vibration.

The invention will be better understood and further objects and advantages thereof will become more apparent from the ensuing detailed description of preferred embodiments taken in conjunction with the drawings.

BRIEF DESCRIPTION OF THE DRAWING

The drawing sets forth a partial cross sectional view of the device which illustrates the invention.

DESCRIPTION OF THE EXEMPLARY EMBODIMENT

A valve unit 1, shown by way of example in the drawing, may be part of a fuel injection valve, not shown in further detail, for fuel injection systems of mixture-compressing internal combustion engines having externally supplied ignition. The valve unit 1 shown may for example be used in a fuel injection valve as described in German Offenlegungsschrift 24 58 728, which corresponds to U.S. Pat. No. 4,007,880. The valve unit 1 is embodied by a valve seat body 2 and a movable valve element 3. The metal valve seat body 2 has a collar 5 on one end, toward which a guide bore 7, extending coaxially with an axis of rotation 6, is open. Remote from the collar 5, the guide bore 7 is adjoined by an enlargement 9 upstream from a conically tapering valve seat face 10, dictated by production conditions, which is larger in diameter than the guide bore 7. The conically tapering valve seat face 10 extends inside the valve seat body 2 from the enlargement 9, terminating at an adjoining injection port 13 which extends to an end face 11 through which fuel is discharged. The movable valve element 3, embodied as a needle, is inserted into the guide bore 7 of the valve seat body 2, in which it is guided by means of a lower guide section 14 and an upper guide section 15. Between the guide sections 14, 15, a connection section 17 of reduced diameter is provided on the movable valve element 3. The movable valve element 3 protrudes out of the guide bore 17 with a reduced diameter neck 18 that is connected to an armature 19. Remote from the armature 19, the movable valve element 3 has a cylindrical section 21 which adjoins the lower guide section 14. Remote from the lower guide section 14 and downstream of the cylindrical section 21, the cylindrical section 21 is adjoined by a narrow in width, conically extending sealing seat 22, which merges with a conically tapering cone section 23. When the fuel injection valve is closed, the sealing seat 22 of the movable valve element 3 rests directly and sealingly on the valve seat face 10 of the valve seat body 2. The cone section 23 is adjoined by a needle tip 25 of known embodiment, which penetrates the injection port 13. On their circumference, the guide sections 14, 15 have flow openings 26, which may for instance be embodied as flats with cylindrical sections between the flats and may for example make the guide sections square in shape. In the radial direction, the connecting section 17 of the movable valve element 3, along with the guide bore 7, defines an annular flow conduit 27. The movable valve element 3 may also be made of metal.

For producing sealing faces of high surface quality on valves in accordance with the invention, an apparatus is provided that is disposed on a machine work bench 31 and is firmly connected to it by means of a securing element 32 that supports a vibration generator 33. The vibration generator 33 is embodied by way of example as a magnetostrictive vibrator, and it converts electrical vibration in the ultrasonic range, that is, high-frequency vibration, into mechanical vibration of low amplitude. The vibration generator 33 is electrically connected to a high-frequency generator 35 and is excited by it in a range between 20 and 30 kHz, that is, the ultrasonic range, and in so doing executes vibration amplitudes of between approximately 3 and 20 μm. A holder unit 37 is secured to the vibration generator 33, for instance by means of screws 36. The holder unit 37 includes a receiving body 39, which has a receiving bore 40 that is open toward a contact end face 41 of the receiving body 39 remote from the vibration generator 33. From the contact end face 41 toward the vibration generator 33, the circumference or jacket of the receiving body 39 is provided with a male thread 43. As a second part of the holder unit 37, a union nut 44 having a female thread 45 is threaded onto the male thread 43 of the receiving body 39. The embodiment or the holder unit 37 by the receiving body 39 and the union nut 44 as described is merely exemplary. Naturally the holder unit may be embodied in any other suitable form and may for instance have a clamp connection, a bayonet mount connection, or the like.

To perform the method, the valve seat body 2 shown as an example is introduced with its cylindrical portion into the receiving bore 40 of the receiving body 39, until the collar 5 provided with a larger diameter comes to rest on the contact end face 41. Next, the union nut 44 is threaded onto the receiving body 39 and presses the collar 5, with a bottom 47 fitting over it, against the contact end face 41 in a manner secured against relative rotation. As already mentioned, the holder unit may also be embodied in any other suitable manner for retaining the valve seat body 2 in such a way as to secure it against relative rotation. The movable valve element 3, embodied as a needle, is guided through a through bore 48 in the bottom 47 and inserted into the guide bore 7 of the valve seat body, causing the sealing seat 22 to come to rest on the valve seat face 10.

For performing the method according to the invention, a coupling body 49 engages the end of the movable valve element 3 which protrudes out of the holder unit 37, this end for instance being the armature 19 connected to the movable valve element 3, so firmly that a rotational motion about the axis of rotation 6 transmitted from a rotary unit 51, such as an electric motor, to the coupling body 49 is matched by the armature 19 and hence by the movable valve element 3. The coupling body may for instance have a cylindrical or conical coupling bore 52, in which the armature 19 is either mechanically braced or frictionally coupled. To produce the operative connection between the rotary unit 51 and the movable valve element 3, the rotary unit 51 is supported in common with the coupling body 49 such that it is vertically movable in the manner indicated by the double arrow 53. Advantageously, during the performance of the method, the movable valve element 3 is acted upon by a force in the direction toward the valve seat face 10. This force is optimally adaptable and is a function of the diameter of the sealing seat 22. To generate this force, either the weight of the coupling body 49 on the movable valve element 3, which is suitably adapted to requirements, or a weight 54 mounted on the coupling body 49, or a compression spring 55, for instance disposed in the coupling bore 52 and supported on the armature 19, may be used. A further element of the apparatus, besides the rotary unit 51, is a lapping medium supply system 56, from which a fine-grained lapping medium can be brought via a lapping medium line 57 to the vicinity of the valve seat face 10 and the sealing seat 22, for instance via the guide bore 7 of the valve seat body 2. However, the lapping medium may instead be applied to the valve seat face 10 and/or the sealing seat 22 prior to the performance of the method. The supply of the lapping medium may also be effected via the injection port 13. Known oily or aqueous slurries of chromium oxide, boron carbide and other substances may be used as the lapping medium. However, it is not absolutely necessary, in performing the method according to the invention, to supply a lapping medium.

To perform the method according to the invention, the valve unit 1 is fastened in the holder unit 37 in the manner described and is rotationally connected to the rotary unit 51. Then, the rotary unit 51 sets the movable valve element 3 into a rotational motion as indicated by an arrow 59; by simultaneously switching on the high-frequency generator 35, a high-frequency vibrational motion 60, represented by a double arrow and acting parallel to the axis of rotation 6, is superimposed upon this rotational motion 59. Here, the movable valve element 3, with the armature 19 and the valve seat body 2, form an added-mass system that is capable of vibration, and they vibrate at the same frequency but with different amplitudes. By modification, the movable valve element 3 could also be fastened on the armature 19 in a holder device in a manner secured against relative rotation, and the rotational motion could be generated by rotation of the valve seat body 2 by means of a rotary unit. The high-frequency vibrational motion could then be brought to bear via the armature and the movable valve element as well. With the optional addition of lapping medium, the sealing seat 22 and the valve seat face 10 are moved to meet one another and to produce intrinsically mutual sealing faces having a high surface quality. The machining time amounts to only a few seconds, for example, 5 seconds.

The sealing faces, treated in accordance with the method described, of the valve units of valves such as fuel injection valves for internal combustion engines fueled by gasoline or Diesel fuel, not only assure very great instantaneous tightness, but also assure tightness after long use of the valve.

The method according to the invention is advantageously usable not only, however, for producing sealing faces having good surface quality in valves with rotationally symmetrical sealing faces, and in which the movable valve element 3 is not secured against relative rotation with the valve seat body 2, so that the valve seat body 2 and the movable valve element 3 can be set into a relative rotational motion 59 during the performance of the method, such that equally good tightness is attained no matter what the relative position of the valve seat body 2 and movable valve element 3. Additionally, the mere imposition of the high-frequency vibrational motion 60 in the axial direction, that is, in the actuation direction of the valve, in which the movable valve element can be lifted from the valve seat face to open the valve, or in the opposite actuation direction for closure of the valve, in which the movable valve element is brought into contact with the valve seat face, or parallel to the axis of rotation 6, without the rotational motion 59, is already sufficient to effect an improvement in the quality of the surface of the sealing faces, or in other words an improvement in the tightness of valves. This form of the method according to the invention is useful if no rotational motion 59 is possible during the performance of the method for structural reasons, such as if the movable valve element 3 is secured against relative rotation with the valve seat body 2, or if the sealing faces have oval, rectangular or other cross sections. It may also, as described above, be suitable to supply a fine-grained lapping medium and/or to subject the movable valve element 3 and tho valve seat body 2 to a force that causes them to move toward one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for producing sealing faces of high surface quality on complementary valve seats and valve faces to be used together in a fuel injection valve for internal combustion engines, having at least one sealing seat provided on at least one movable valve element and having at least one complementary valve seat face embodied on at least one valve seat body, which comprises directing said at least one sealing seat of said at least one movable valve element into contact with said at least one valve seat face, placing said at least one valve seat body into a holder unit (37) for receiving and fixedly holding said at least one valve seat body, setting one of said at least one movable valve element and said at least one valve seat body into a constant rotational motion in only one direction relative to one another about an axis of rotation (6), delivering a slurried, fine-grained lapping medium to said at least one valve seat face, connecting a high frequency generator (35) electrically to a vibration generator which engages said holder unit (37) to produce an ultrasonic range high frequency vibrational motion (60) which acts parallel to the axis of rotation (6) and which is transmitted via said holder unit (37) to said at least one valve seat body (2) and to said at least one movable valve element (3) via said at least one valve seat body.

2. A method as defined by claim 1, which comprises applying a force (49, 54, 55) upon said at least one movable valve element in a direction toward said at least one valve seat face (10).

3. A method for producing sealing faces of high surface quality on complementary valve seats and valve faces to be used together in a fuel injection valve for internal combustion engines, having at least one sealing seat provided on at least one movable valve element and having at least one complementary valve seat face embodied on at least one valve seat body, which comprises directing said at least one sealing seat of said at least one movable valve element into contact with said at least one valve seat face, placing said at least one valve seat body into a holder unit (37) for receiving and fixedly holding said at least one valve seat body, rotating said at least one movable valve element and said at least one valve seat body into a constant rotational motion in only one direction relative to one another about an axis of rotation (6), and connecting a high frequency generator (35) electrically to a vibrational generator (33) which engages said holder unit (37) to produce an ultrasonic range high frequency vibrational motion (60) via said holder unit (37) onto said at least one valve seat body (2) and via said at least one valve seat body onto said at least one movable valve element (3) which acts in an actuation direction of said valve.

4. A method as defined in claim 1 in which said at least one sealing seat and at least one movable valve element are to be used together in a valve unit subsequent to forming sealing faces of high surface quality.

5. A method as set forth in claim 1 in which the vibration amplitude is from about 3 to about 20 $\mu$m.

6. A method as set forth in claim 1, in which said ultrasonic range high frequency is from about 20 kHz to about 30 kHz.

7. A method as set forth in claim 3, in which said ultrasonic range high frequency is from about 20 kHz to about 30 kHz.

* * * * *